United States Patent [19]

Ryan et al.

[11] 3,967,990

[45] July 6, 1976

[54] COMBINATION OF BAND-TYPE AND LINE-TYPE EMISSION PHOSPHORS WITH EXPLOSIVE

[75] Inventors: Frederick M. Ryan, New Alexandria, Pa.; Frank M. Vodoklys, Wayne, N.J.

[73] Assignee: The United States of America as represented by the Secretary of the Interior, Washington, D.C.

[22] Filed: Mar. 3, 1975

[21] Appl. No.: 554,839

[52] U.S. Cl. ..... 149/109.4; 149/2; 149/21; 252/301.4 R; 252/301.6 R

[51] Int. Cl.[2] ..... C06B 45/00

[58] Field of Search ..... 149/2, 17, 21, 109.4; 102/27 R; 252/301.4 R, 301.6 R

[56] References Cited

UNITED STATES PATENTS

| | | | |
|---|---|---|---|
| 3,746,652 | 7/1973 | Mathers | 252/301.4 R |
| 3,772,099 | 11/1973 | Ryan et al. | 149/17 X |
| 3,772,200 | 11/1973 | Livesay | 149/2 X |
| 3,789,014 | 1/1974 | Graff et al. | 252/301.4 R |
| 3,897,284 | 7/1975 | Livesay | 149/21 |

*Primary Examiner*—Edward A. Miller
*Attorney, Agent, or Firm*—William S. Brown; Donald R. Fraser

[57] ABSTRACT

An inorganic fluorescent phosphor consisting of a spotting phosphor and a coding phosphor is employed for tagging purposes, as for example, tagging explosives to provide post detonation information. The spotting phosphor consists of an inorganic fluorescent material which is excited by UV to produce readily detectable band-type emission, but which produces little or no emission at certain excitation wave lengths. The coding phosphor consists of a different inorganic fluorescent material which emits a line-type emission and which fluoresces efficiently at those excitation wave lengths at which the spotting phosphor produces little or no emission. Exemplary spotting phosphors are zinc silicate and calcium silicate activated by manganese, which show no excitation at a UV radiation of 325 nm. Suitable coding phosphors are yttrium vanadate activated by trivalent rare earth ions, such as europium, thulium, erbium, dysprosium or Samarium. This combination of spotters and coding phosphors in cemented phosphor grains employed for tagging purposes enables the quantity of expensive coding phosphors required to be drastically reduced.

7 Claims, 1 Drawing Figure

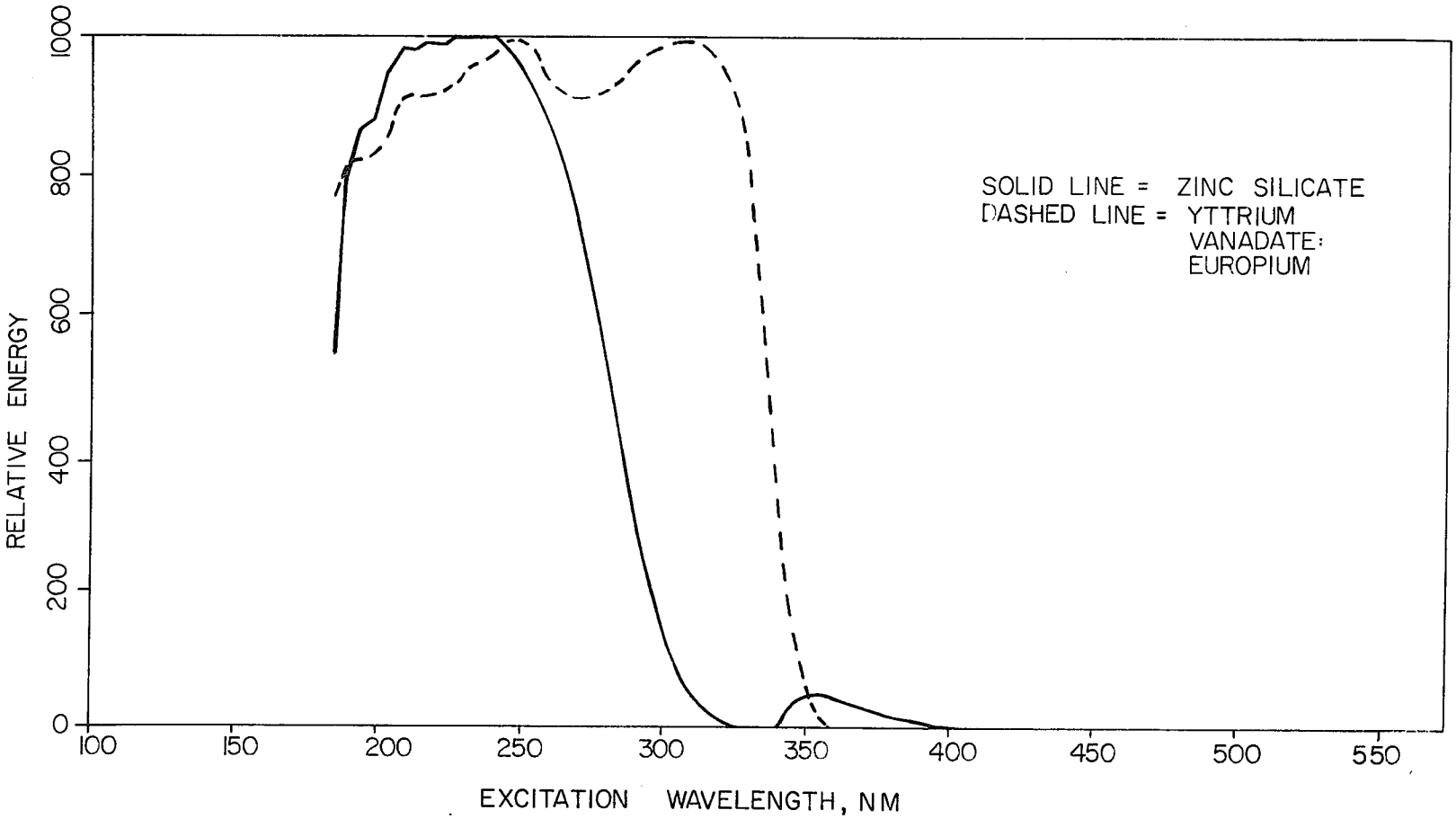
SOLID LINE = ZINC SILICATE
DASHED LINE = YTTRIUM VANADATE: EUROPIUM
RELATIVE ENERGY
1000
800
600
400
200
0
100
150
200
250
300
350
400
450
500
550
EXCITATION WAVELENGTH, NM

COMBINATION OF BAND-TYPE AND LINE-TYPE EMISSION PHOSPHORS WITH EXPLOSIVE

THE INVENTION

U.S. Pat. No. 3,772,099, issued Nov. 13, 1973 to Frederick M. Ryan and Robert C. Miller and assigned to Westinghouse Electric Corporation is incorporated by reference herewith. This patent describes fluorescent tagging means for explosives to provide post detonation information comprising (1) a spotting phosphor which can be excited by UV radiation to provide a band-type emission and (2) a coding phosphor which emits a line-type emission.

Both phosphors are incorporated into cemented phosphor grains of fine particle size which are dispersed in the explosive. After an explosion, phosphor grains can be located by UV irradiation of the spotting phosphor and the information on the coding phosphor can then be decoded.

The spotting phosphor is typically an inexpensive phosphor emitting over a fairly broad region of the visible spectrum and is used primarily as a means of locating the phosphor grain. The coding phosphor, which is generally quite costly, contains information about the explosive, such as the manufacturer and the type. This information is contained in a binary code which is established by the presence (or absence) of the specific fluorescence emissions of each coding phosphor. To be capable of containing a large amount of information in such a code it is desirable that each coding phosphor emit only over a very narrow emission wavelength range so that a given wave length range can contain as many coding phosphors (coding elements) as possible. Phosphors activated with trivalent rare earth ions best fill this criterion. Due to cost considerations, it is desirable to use as small an amount of the coding phosphors as possible when making up the cemented phosphor grains.

In the present invention the reduction of the minimum quantity of coding phosphor required to be incorporated in the cemented grains in order to extract the code contained therein is achieved by selecting coding phosphors which fluoresce efficiently when excited by ultraviolet radiation at a wave length to which spotting phosphors are insensitive. This allows the relatively weak fluorescent emissions of the coding phosphors to be detected free of any fluorescent interference from the spotting phosphor.

Among the objects of the present invention are:

1. To provide a tagging fluorescent phosphor grain comprising a band-type spotting phosphor which produces little or no emission at certain excitation wave lengths and a coding phosphor which emits a line-type emission at the excitation wave lengths at which the spotting phosphor has little or no emission;
2. To employ the tagging phosphor grain of 1 as an indicia means for providing information concerning items in which said grains are incorporated;
3. To employ the phosphor grains of 1 as an indicia for explosives in order to provide post-explosion information concerning the said explosives;
4. To provide an explosive composition containing the said tagging fluorescent phosphor grains of 1;
5. To provide tagging fluorescent phosphor grain of 1 wherein the band-type spotting phosphor consists of zinc silicate, or calcium silicate activated with manganese;
6. To provide a tagging fluorescent phosphor grain of 5 wherein the coding phosphor consists of a yttrium vanadate phosphor activated by a trivalent rare earth ion; and
7. To provide a coding phosphor in 5 wherein the activating trivalent rare earth ion is europium, thalium, erbium, dysprosium or samarium.

Further objects will become apparent from the following description of the invention and the claims appended thereto.

BRIEF DESCRIPTION OF THE DRAWING

The FIGURE shows graphs of the fluorescence excitation spectra of zinc silicate and yttrium vanadate:europium respectively, showing the relative energy versus UV excitation wave length.

As shown in the FIGURE, zinc silicate is efficiently excited by UV radiation between 180 and 315 nm; weakly excited by wavelengths between 340 and 400 nm; and has zero excitation at 325. With zinc silicate as a spotting phosphor, according to this invention the coding phosphor should be one which fluoresces strongly at 325 nm. Calcium silicate activated with manganese does not excite at 325 nm, and may likewise be employed.

A typical example of a coding phosphor employed in this invention is europium activated yttrium vanadate. As shown in the FIGURE, at 325 nm UV excitation it has close to its maximum spectral energy. Similar fluorescent activity at 325 nm UV radiation is shown by yttrium vanadate activated by various trivalent rare earth ions, such as thulium, erbium, dysprosium or samarium.

By using a zinc silicate, or calcium silicate activated with manganese spotting phosphor, in combination with a yttrium vanadate activated by the rare earths in preparing the phosphor grains according to the method of U.S. Pat. No. 3,772,099, the amount of coding phosphor required has been drastically reduced. Thus, in the specific example given in column 5 of U.S. Pat. No. 3,772,099, the quantity of coding phosphor employed is about 11%, while using the teachings of the present invention the minimum quantity of coding phosphor is as low as 1% by weight of the spotting phosphor.

Recent quotations give the cost of zinc silicate:manganese as \$4.58/lb and yttrium vanadate:dysprosium as \$160.00/lb. Following the said example of U.S. Pat. No. 3,772,099 the cost of the phosphor materials employed in the tagging phosphor would be \$20.12/lb ($0.9 \times \$4.58 + 0.1 \times \$160.00$), while according to the present invention the cost would be as low as \$6.13/lb ($0.99 \times \$4.58 + 0.01 \times \$160.00$), a 69.5% reduction.

It is believed apparent that in addition to the specific spotting and coding phosphors set forth above, other phosphors may be employed which meet the following emission requirements: (1) that the spotting phosphor have a readily detectable band-type emission but which produces little or no emission at certain excitation wavelengths, and (2) that the coding phosphor emits a line-type emission and which fluoresces efficiently at those excitation wavelengths at which the spotting phosphor produces little or no emissions.

In addition to being used for tagging explosives, the phosphor compositions of the present invention are capable of serving as tagging means for units of production and for items in general.

What is claimed is:

1. A fluorescent tagging phosphor composition comprising:

a spotting phosphor having zero excitation at a UV wavelength of 325 nm, said phosphor consisting of zinc silicate or calcium silicate activated with manganese; and about 1% by weight of the spotting phosphor of a coding phosphor which fluoresces strongly at a UV wavelength of 325 nm, said coding phosphor consisting of yttrium vanadate activated with a trivalent rare earth ion.

2. The composition of claim 1 wherein the spotting phosphor is zinc silicate and the coding phosphor is yttrium vanadate activated by europium.

3. The composition of claim 1 wherein the spotting phosphor is zinc silicate and the coding phosphor is yttrium vanadate activated by thulium.

4. The composition of claim 1 wherein the spotting phosphor is zinc silicate and the coding phosphor is yttrium vanadate activated by erbium.

5. The composition of claim 1 wherein the spotting phosphor is zinc silicate and the coding phosphor is yttrium vanadate activated by dyprosium.

6. The composition of claim 1 wherein the spotting phosphor is zinc silicate and the coding phosphor is yttrium vanadate activated by samarium.

7. An explosive material tagged with the composition of claim 1.

* * * * *